US006780056B1

(12) United States Patent
Neidich

(10) Patent No.: US 6,780,056 B1
(45) Date of Patent: Aug. 24, 2004

(54) EMI-SHIELDED INTERPOSER ASSEMBLY

(75) Inventor: Douglas A. Neidich, Harrisburg, PA (US)

(73) Assignee: InterCon Systems, Inc., Harrisburg, PA (US)

( * ) Notice: Subject to any disclaimer, the term of this patent is extended or adjusted under 35 U.S.C. 154(b) by 0 days.

(21) Appl. No.: 10/631,525

(22) Filed: Jul. 31, 2003

(51) Int. Cl.[7] ..... H01R 13/648
(52) U.S. Cl. ..... 439/607; 439/66
(58) Field of Search ..... 439/607, 66, 81, 439/82, 88, 92; 361/818, 816; 174/35 R

(56) References Cited

U.S. PATENT DOCUMENTS

| | | | | | |
|---|---|---|---|---|---|
| 2,597,081 | A | | 5/1952 | Goodhue | 178/44 |
| 4,155,615 | A | | 5/1979 | Zimmerman, Jr. et al. | 339/14 |
| 4,433,886 | A | | 2/1984 | Cassarly et al. | 339/14 R |
| 5,241,453 | A | | 8/1993 | Bright et al. | 361/704 |
| 5,357,404 | A | | 10/1994 | Bright et al. | 361/818 |
| 5,525,066 | A | | 6/1996 | Morlion et al. | 439/108 |
| 5,572,408 | A | | 11/1996 | Anhalt et al. | 361/737 |
| 5,588,851 | A | | 12/1996 | Morlion et al. | 439/108 |
| 5,748,455 | A | | 5/1998 | Phillips et al. | 174/35 R |
| 5,991,165 | A | | 11/1999 | Jones, Jr. et al. | 361/816 |
| 6,033,236 | A | | 3/2000 | McHugh et al. | 439/74 |
| 6,042,398 | A | | 3/2000 | Wu et al. | 439/101 |
| 6,088,231 | A | * | 7/2000 | Fajardo | 361/816 |
| 6,095,824 | A | | 8/2000 | McHugh | 439/74 |
| 6,140,577 | A | | 10/2000 | Rapaich et al. | 174/35 R |
| 6,191,368 | B1 | | 2/2001 | Di Stefano et al. | 174/260 |
| 6,205,026 | B1 | | 3/2001 | Wong et al. | 361/704 |
| 6,259,609 | B1 | | 7/2001 | Kurz | 361/818 |
| 6,278,617 | B1 | | 8/2001 | Yang et al. | 361/818 |
| 6,288,330 | B1 | | 9/2001 | Chen | 174/35 R |
| 6,315,576 | B1 | * | 11/2001 | Neidich | 439/66 |
| 6,358,063 | B1 | * | 3/2002 | Neidich | 439/66 |
| 6,362,977 | B1 | | 3/2002 | Tucker et al. | 361/818 |
| 6,375,474 | B1 | | 4/2002 | Harper, Jr. et al. | 439/66 |
| 6,400,577 | B1 | | 6/2002 | Goodwin et al. | 361/816 |
| 6,420,661 | B1 | | 7/2002 | Di Stefano et al. | 174/260 |
| 6,471,525 | B1 | | 10/2002 | Fan et al. | 439/70 |
| 6,538,903 | B1 | * | 3/2003 | Radu et al. | 439/607 |
| 6,683,796 | B2 | | 1/2004 | Radu et al. | 361/818 |
| 2001/0019905 | A1 | | 9/2001 | Stefano et al. | 439/66 |
| 2002/0196614 | A1 | | 12/2002 | Dibene, II et al. | 361/803 |

* cited by examiner

*Primary Examiner*—Gary F. Paumen
*Assistant Examiner*—Briggitte R. Hammond
(74) *Attorney, Agent, or Firm*—Hooker & Habib, P.C.

(57) ABSTRACT

A frame for holding an interposer or other circuit device sandwiched between a pair of circuit members includes an EMI shield surrounding the frame. Contact arms extend from the shield and engage the circuit members to electrically or thermally interconnect the EMI shield with the circuit members.

28 Claims, 6 Drawing Sheets

EMI-SHIELDED INTERPOSER ASSEMBLY

FIELD OF THE INVENTION

The invention relates to interposer assemblies used for forming electrical connections between spaced contact pads on circuit members.

BACKGROUND OF THE INVENTION

Interposer assemblies form electrical connections between densely spaced contact pads on adjacent parallel circuit members. An interposer assembly includes an interposer mounted in a frame. The interposer is a circuit device that includes a flat plate holding a number of contact members in a predetermined pattern. The frame positions the interposer between the circuit members with contact members aligned with opposite pairs of contact pads. The circuit members are pressed against the interposer and sandwich the interposer plate between them. The contact members compress between pairs of contact pads and interconnect the circuit members to form an electronics package.

Interposer assemblies are used wherever dense connections are required in an electronics package to transmit electrical signals, including data, between circuit members. The assemblies are particularly well suited for electronic packages used in electronic devices such as cellular telephones, portable digital assistants, notebook computers, control circuits and the like, and enable a reduction in the size and weight of such devices.

Electronic packages are becoming smaller in size and yet are providing ever-increasing levels of performance. Circuit members have more contact pads packed into less space and operate at faster speeds. Despite increases in contact density and operating speeds, interposer assemblies in high-performance electronic packages must make highly reliable and dependable electrical connections that maintain signal integrity between circuit members Increased contact density and operating speeds, however, cause signal integrity to become sensitive to electromagnetic interference or "EMI". EMI is generated by circuit devices such as microprocessors, and may affect electrical signals in other circuit devices or other electronic packages in an electronic device.

As the performance of circuit members interconnected by interposer assemblies increases, it becomes desirable to shield interposer assemblies from EMI to maintain reliable signal integrity. EMI shields are known that shield circuit devices from EMI emitted by other circuit devices, and block emission of EMI generated by the circuit device itself. These shields, however, are not designed for use with interposer assemblies.

One known interposer assembly has a number of EMI shields that each individually shields a contact member in the plate. Shielding individual contact members is complex and expensive, and is not feasible for many types of interposer assemblies.

Thus, there is a need for an improved EMI-shielded interposer assembly for interconnecting high-performance circuit members of an electronics package. The shielded interposer assembly should be easily manufactured and be usable with different types of interposer assemblies.

SUMMARY OF THE INVENTION

The invention is an improved frame for use in an interposer assembly. The frame includes an EMI shield that shields the interposer from EMI. The improved frame is easily manufactured and is usable with many types of interposer assemblies. As an added benefit the improved frame of the present invention is readily adaptable to hold other electronic devices in addition to interposers.

An improved EMI-shielded frame for holding an interposer or other circuit in accordance with the present invention includes a socket for holding the circuit and an EMI shield assembly at least partially surrounding the socket. The socket includes a wall surrounding a central opening extending through the socket for receiving the circuit device. The wall includes an inner surface facing the opening, an outer surface defining the outer perimeter of the wall, and top and bottom surfaces.

The shield assembly faces the outer and bottom wall surfaces and includes an EMI shield facing the outer surface of the socket and at least one contact arm extending from the shield and electrically or thermally connected to the shield. Each contact arm extends from below the bottom wall surface inwardly beyond the inner wall surface to a free end, with a contact surface on the free end to face one of the circuit members. The contact surface engages the one circuit member when the circuit device is sandwiched between the circuit members and electrically or thermally interconnect the one circuit member with the EMI shield.

In a preferred embodiment the circuit device is an interposer having a flat plate and a number of contacts in the plate. The plate has top and bottom sides separated by the thickness of the plate. The interposer contacts have opposed contact noses normally separated by a distance greater than the thickness of the plate.

The shield assembly includes a number of upwardly bent contact arms that have contact noses spaced above the interposer plate and a number of downwardly bent contact arms that have contact noses spaced below the interposer plate. When the interposer is sandwiched between the circuit members, one circuit member engages the contact noses of the upwardly bent contact arms and the other circuit member engages the contact noses of the downwardly bent contact arms. The contact arms electrically or thermally interconnect both circuit members with the EMI shield and may, in some applications, interconnect the shield with the grounds of the circuit members.

In other embodiments one of the circuit members is a heat sink. The contact arms conduct heat from the EMI shield to the heat sink. In yet other embodiments the circuit device is an active device that generates EMI. The EMI shield reduces EMI transmissions from the active device to other electronic devices while interconnecting one or both circuit members to the EMI shield.

The EMI-shielded frame of the present invention has a number of advantages. The EMI shield surrounds and shields the interposer plate and interposer contacts without shielding individual interposer contacts. The contact arms can electrically connect or tie in the EMI shield to the grounds of the circuit members, which is advantageous in many applications. The shield assembly may be manufactured from sheet metal and can be made of individual members that are easily mounted to the frame. The frame is readily adaptable for use in different types of interposer assemblies or other types of electronic packages.

Other objects and features of the invention will become apparent as the description proceeds, especially when taken in conjunction with the accompanying drawings illustrating the invention, of which there are six sheets of drawings of five embodiments.

DESCRIPTION OF THE PREFERRED EMBODIMENTS

Figure 1:
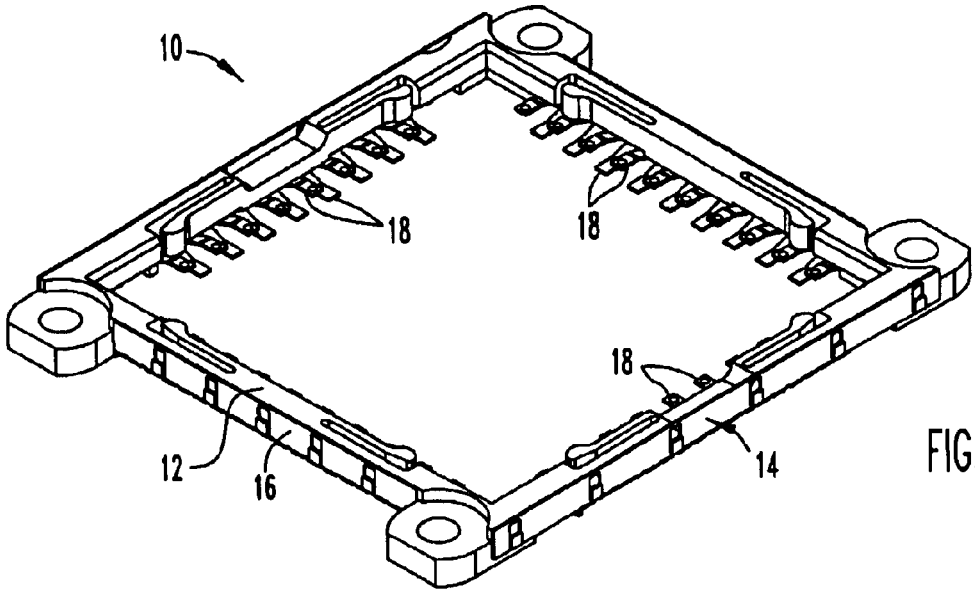
FIG. 1 is a perspective view of an EMI-shielded frame in accordance with the present invention.
Figure 2:
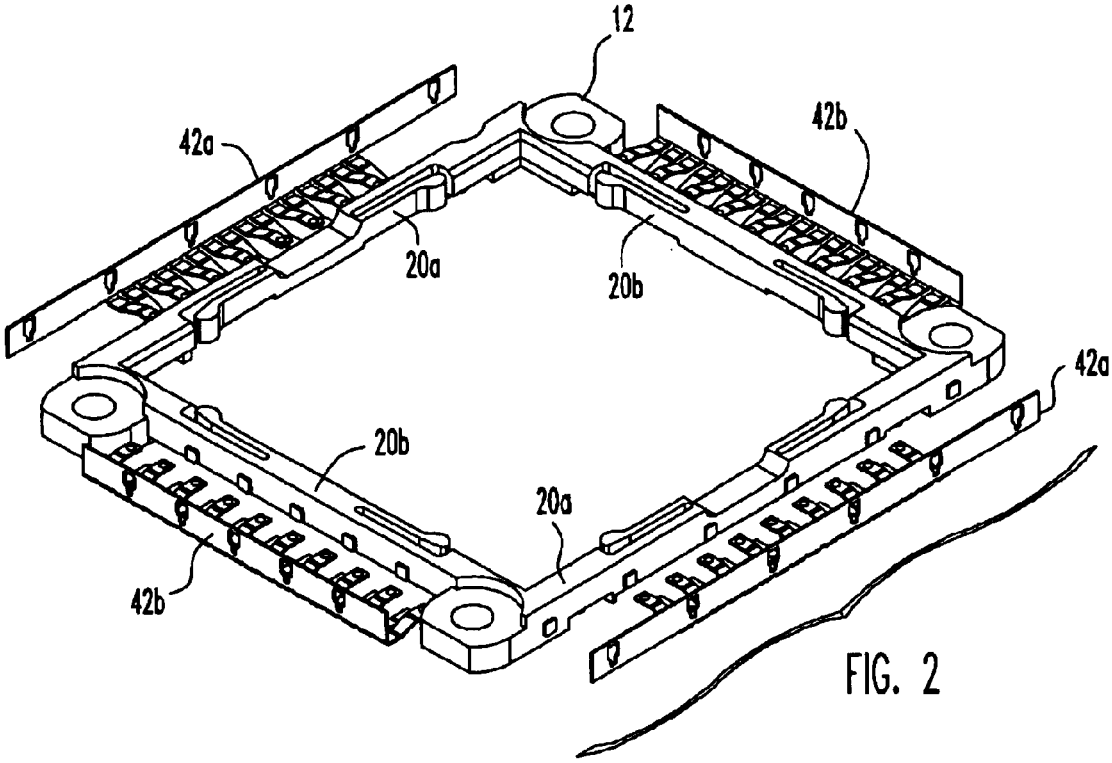
FIG. 2 is an exploded view of the frame shown in FIG. 1.
Figure 3:
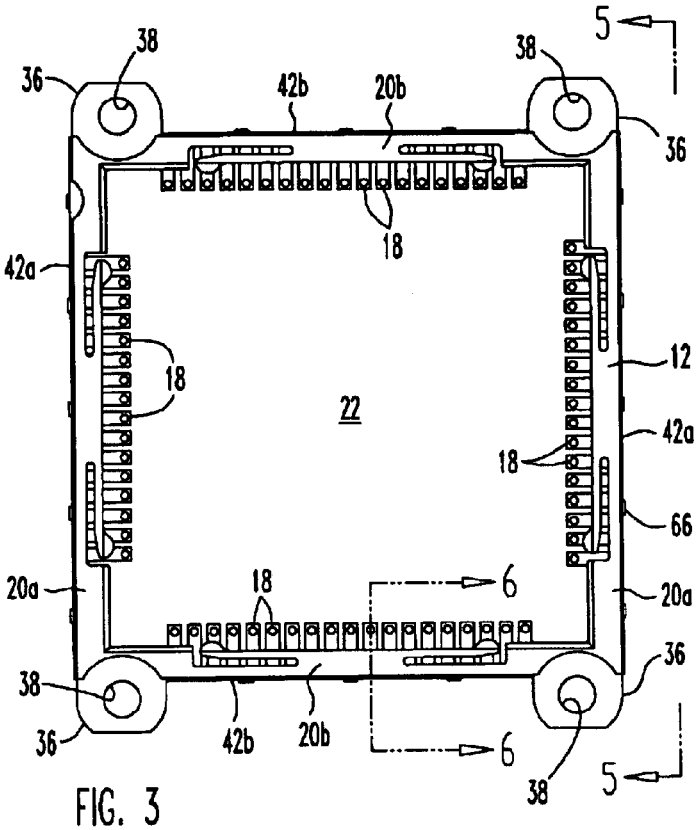
FIG. 3 is a top view of the frame shown in FIG. 1.
Figure 5:
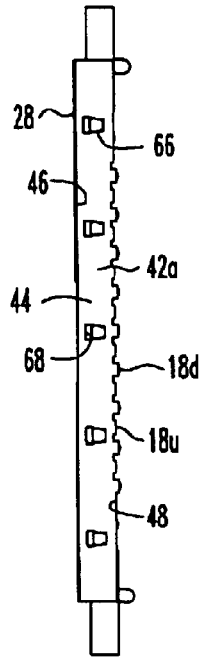
FIG. 5 is a side view taken along line 4—4 of FIG. 3.
Figure 4:
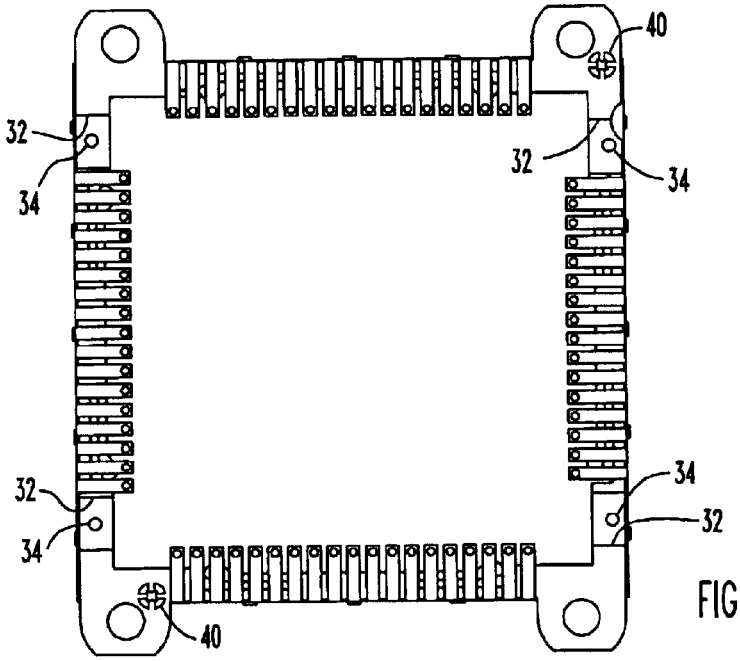
FIG. 4 is a bottom view of the frame shown in FIG. 1.

FIGS. 1–6 illustrate a first embodiment EMI-shielded frame 10 in accordance with the present invention. The frame 10 is used in an interposer assembly that includes an interposer to be sandwiched between a pair of circuit members. The figures illustrate the frame prior to mounting the interposer.

The frame 10 includes a hollow socket 12 that is configured to hold the interposer and locate the assembly against one of the circuit members. The socket 12 is similar to that disclosed in my U.S. Pat. No. 6,358,063, which is incorporated by reference as if fully set forth herein. Other types or styles of interposer sockets are known that are readily adaptable for use in accordance with the present invention. An electrically conductive EMI shield assembly 14 substantially surrounds the outer perimeter of the socket and includes an EMI shield 16 and a number of elongate contact arms 18 that interconnect the circuit members with the EMI shield 16 as will be described later below.

The socket 12 is a hollow rectangular body that receives the interposer and includes two pairs of opposing side walls 20*a* and 20*b* that surround and define a central opening or socket interior 22. Each side wall 20 has an inner side 24 facing the interior 22, an outer side 26 defining the outer perimeter of the socket, and top and bottom sides 28 and 30.

The side walls 20 include structure to hold the interposer in a predetermined relationship with the frame 10 and locate the socket 12 against one of the circuit members. Two pairs of recesses 32 are formed on opposing pairs of side walls 20*a* open to the bottom wall side 30. Mounting pins 34 extend from the base of the recesses. Mounting ears 36 extend outwardly from the corners of the socket and include through mounting holes 38. Diagonally opposed locater posts 40 are located adjacent a diagonal pair of the mounting holes 38. Mounting and locating structures 32–40 are conventional and will not be described in further detail.

EMI shield assembly 14 extends along the outer perimeter of the socket 12 and faces the outer and bottom wall surfaces 26, 30. Shield assembly 14 is formed from two pairs of individual shield members 42, with shield members 42*a* mounted to side walls 20*a* and shield members 42*b* mounted to side walls 20*b* (shown separated in FIG. 2). Each shield member 42 extends from the mounting ear 36 on one end of the side wall to the mounting ear 36 on the other end of the side wall. The shield members 42 cooperate to completely surround the outer periphery of the socket 12 except where the mounting ears 36 extend from the socket corners.

Other types of sockets adapted for use in the present invention may have mounting structure different than the mounting structure of socket 12. Such sockets may permit the shield assembly 14 to completely surround the socket. In these embodiments EMI shield assembly 14 can be a one-piece member totally surrounding the socket or can be formed from a number of individual members similar to shield members 42.

Each shield member 42 includes a shield plate 44 that overlies a respective outer wall side 26 and extends along the length of the shield member. The shield plates 44 collectively form EMI shield 16. A set of contact arms 18 extend from the shield plate 44 and below bottom wall side 30. The contact arms 18 are uniformly spaced along the length of the shield plate, with the contact arms 18 of shield member 42*a* located between the plate recesses 32 and the contact arms 18 of shield member 42*b* spaced nearly the full length of the members.

The interior surface 46 of each bottom wall side 30 facing the set of contact arms 18 is recessed upwardly to reduce the height of the wall and provide clearance for the contact arms when socket 12 is pressed against one of the circuit members. The outer ends of the walls 20*a*, 20*b* are at full height and support the socket 12 against the one circuit member.

In this embodiment each shield member 42 has a respective set of contact arms 18. In other embodiments not all shield members may carry contact arms. The size, spacing and number of the contact arms 18 may also vary among the shield members. For example, one shield member 42*a* of the illustrated embodiment has a set of sixteen contact arms and the other shield member 42*a* has a set of seventeen contact arms. If a shield member does not carry contact arms, the wall carrying the shield member may be at full height its entire length.

Each shield plate 44 is a flat sheet that faces the outer wall side 26 and has a height nearly the height of the wall. The shield plate 44 extends from a top edge 48 closely spaced from the upper side of the frame 12 to a bottom edge 50 adjacent the bottom of the frame.

Each contact arm 18 is a resilient cantilever beam extending from the bottom of its respective shield plate 44. The contact arm 18 has a curved transition portion 52 that wraps around the bottom edge of the wall and an elongate spring arm portion 54 extending from curved portion 52. The edge of the wall between the wall outer and bottom sides has a generous fillet radius 56 that enables the arm to curve smoothly around the lower edge of the wall without high stress concentration. The spring arm 54 extends beyond inner wall side 24 to a free end 58 spaced a uniform horizontal distance from the wall 20. The beam has a uniform width and thickness along its length. A hemispherical contact dimple 60 is formed near the free end of the spring arm 54 and defines a contact nose of the contact arm.

Figure 6:
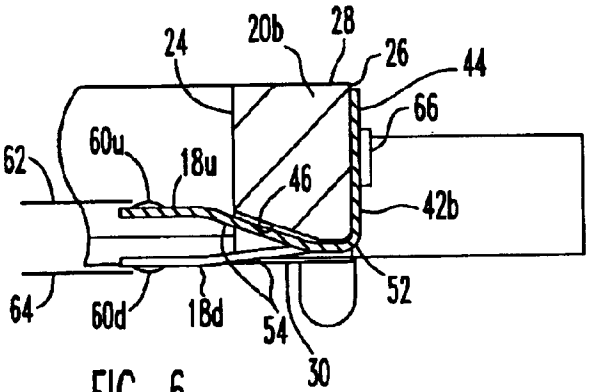
FIG. 6 is a sectional view taken along line 6—6 of FIG. 3.

Alternate arms 18*u* and 18*d* have upwardly bent and downwardly bent non-horizontal spring arms 54 respectively extending from the curved arm portions 52 (see FIG. 6). Wall surface 46 slopes upwardly from the wall outer surface towards the inner surface to accommodate the upwardly bent arms 18*u*. In other embodiments two or more upwardly bent arms 18*u* or two or more downwardly bent arms 18*d* can be adjacent each other.

In yet other embodiments the upwardly bent spring arms or the downwardly bent spring arms are horizontal and extend perpendicularly to the shield plate 44.

The contact dimples 60*u* of the upwardly bent arms 18*u* extend upwardly to a common horizontal plane 62. The contact dimples 60*d* of the downwardly bent arms 18*d* extend downwardly to a common horizontal plane 64 below the upper contacts. The contact dimples 60*u*, 60*d* form respectively vertically spaced upper and lower linear arrays of contacts spaced a uniform distance from each side wall 20.

Figure 7:
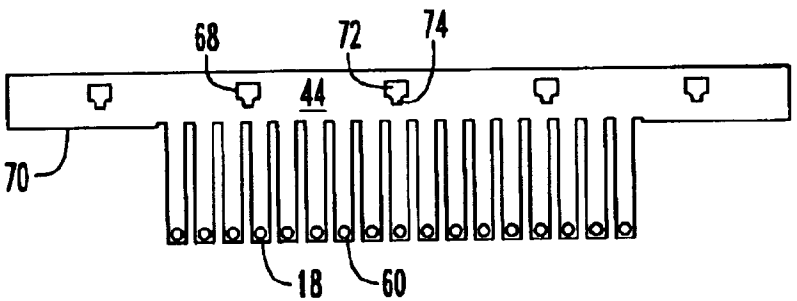
FIG. 7 is a front view of a preform for manufacturing the shield member shown in FIG. 5.

Shield members 42*a* and 42*b* are mounted to walls 20*a* or 20*b* on projections 66 that extend outwardly from each wall 20. The projections 66 are spaced along the length of the wall and extend through correspondingly spaced cutouts or slots 68 (best shown in FIG. 7) formed in the shield plate 44. The projections 66 and slots 68 cooperate to mount and hold the shield members 42 on the walls 20 as will be described in greater detail below.

The shield members 42 are each formed from a single-piece preform 70 stamped from plated sheet metal. See FIG. 7, which illustrates the preform for shield member 42*a*. In the illustrated embodiment the sheet is 0.008 inches thick. The slots 68 and the contact arms 18 are stamped from the sheet metal. The developed lengths of the upper and lower contact arms 18*u*, 18*d* are equal in the illustrated embodiment but could differ from each other in other embodiments. Contact dimples 60 are formed on the ends of the arms.

The preform is positioned on the outside of a wall 20 via projections 66 and slots 68. The lower end of the preform is bent around the lower edge of the wall and the contact arms are bent upwardly and downwardly to locate the upper and lower rows of contact noses 60 as previously described.

Each slot 68 is a "T-slot" having an upper nominal width section 72 and a lower reduced width section 74 respectively (see FIG. 6). Sloped slot edges 76 extend between the upper and lower slot sections. Each projection 66 has an outer retaining plate 78 mounted on the end of a post 80 (see FIGS. 7*a*, 7*b* and 8). The retaining plate is configured to fit through nominal-width slot portion 72. The post 80 is sized to closely fit the reduced-width slot portion 74.

Figure 9:
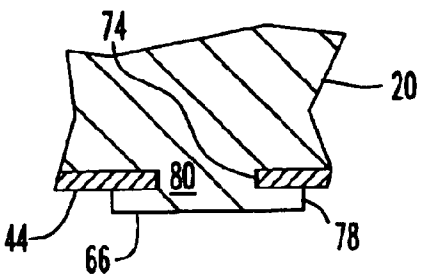
FIG. 9 is a partial sectional view taken along line 9—9 of FIG. 8*b;*
Figure 8B:
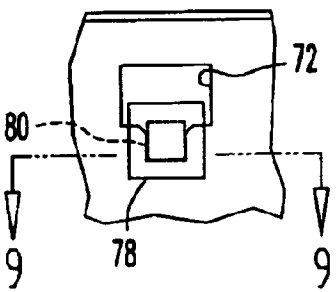
FIG. 8*b* is similar to FIG. 8*a* but shows the preform in its installed position.
Figure 8A:
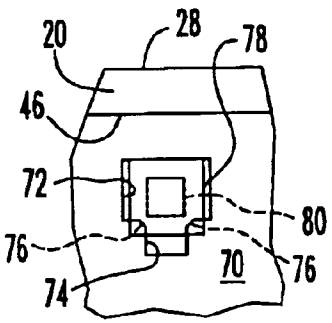
FIG. 8*a* is a front view showing installation of the preform shown in FIG. 7 on the socket.

When attaching a preform 70 to a wall 20, retaining plates 78 are inserted through slot sections 72 as shown in FIG. 8*a*. The shield members 42 are moved upwardly with respect to the socket 12 to receive the posts 80 into the reduced-width slot portions 74 as shown in FIG. 8*b*. Slot edges 76 guide the posts 80 into the slot sections 74 without hanging. The retaining plates 78 now extend beyond the lateral edges of the slots 68 and cooperate with the posts 80 to hold the preform on the wall 20, see FIG. 9.

After the preform is formed into a shield member 42, projections 66, slots 68 and the curved contact arm portions 52 cooperate to fixedly hold the shield member 42 on the socket wall 20. Other conventional structures for mounting EMI shields to walls can be adapted for use in alternative embodiments of the present invention.

Figure 10:
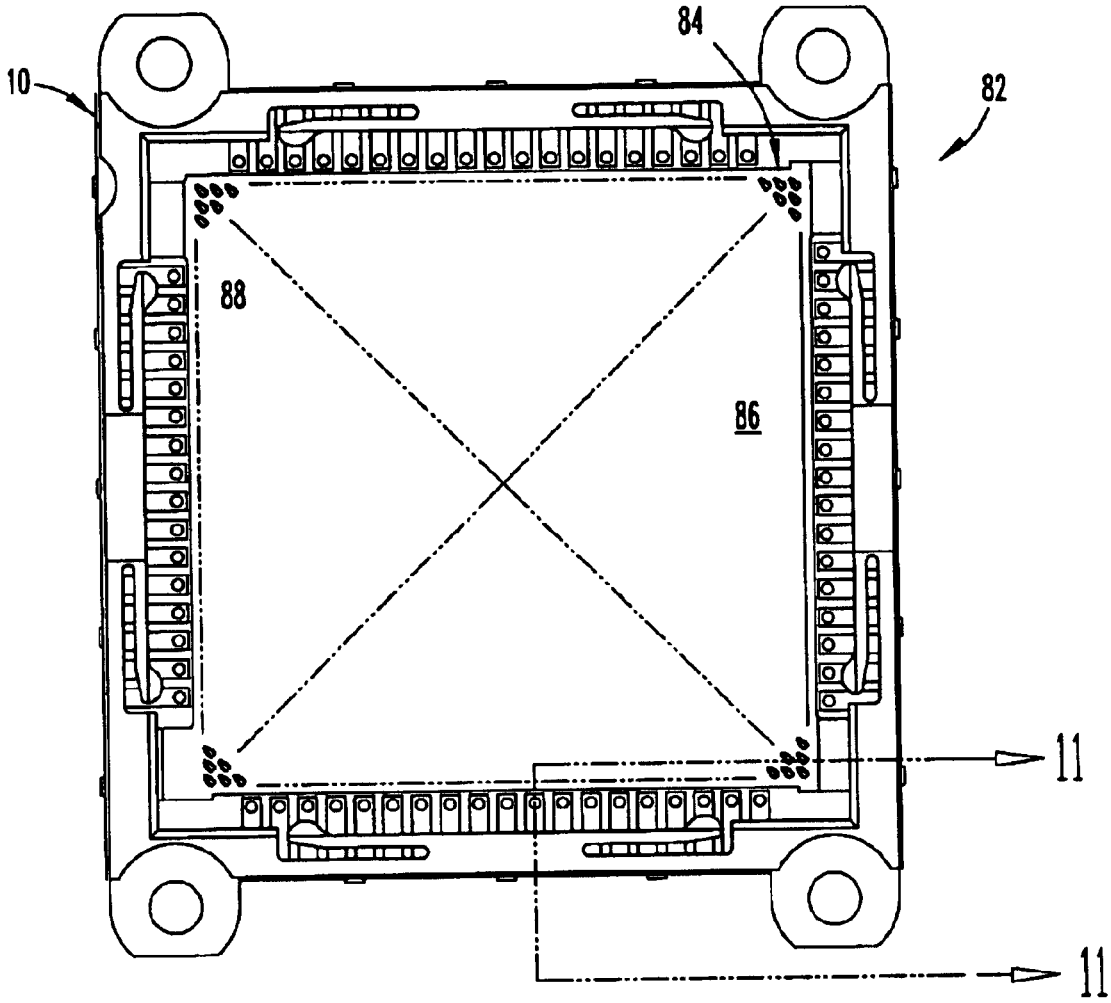
FIG. 10 is a view similar to FIG. 3 but including an interposer fastened in the frame to form an interposer assembly.
Figure 11:
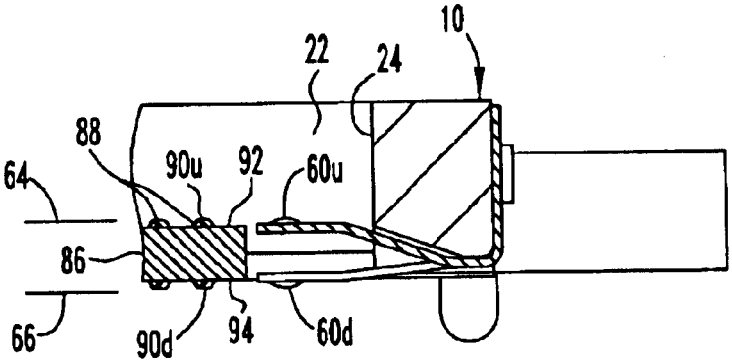
FIG. 11 is a partial sectional view of the interposer assembly shown in FIG. 10 and taken along lines 11—11 of FIG. 10.

FIGS. 10 and 11 illustrate an interposer assembly 82 with an interposer 84 held in the frame 10. The interposer 84 is similar to the interposer disclosed in my U.S. Pat. No. 6,315,576 previously incorporated by reference herein. Other types or designs of interposers can be used in this invention. The interposer 84 is permanently fastened to the socket 12 in a conventional manner using socket mounting structure 32–40.

Interposer 84 includes a flat plate 86 formed of insulating material with a plurality of closely spaced, metal through contacts 88 held in the plate and extending through the thickness of the plate. For clarity, only a few of the interposer contacts are shown in FIG. 10. The interposer plate 86 is spaced from the socket wall inner sides 24 and the ends of the contact arms 18 are between the interposer plate 86 and the inner wall sides 24.

Interposer contacts 88 are arranged in a pre-determined 2-dimensional pattern to form electrical connections between upper and lower circuit boards. Each interposer contact has an upper contact nose 90*u* adjacent the upper side 92 of the plate and a lower contact nose 90*d* adjacent the lower side 94 of the plate. The contact noses 90*u*, 90*d* are configured to engage respective contact pads on the circuit boards.

As shown in FIG. 11, the interposer 84 is held in socket interior 22 with plate lower side 94 essentially flush with the bottom of the socket 12. Plate edges 96 extending between the plate top and bottom sides are spaced from the frame inner sides 24 and closely face the adjacent contact arms 18. The upper and lower contact arm noses 60*u*, 60*d* are spaced apart a distance greater than the thickness of the plate 86, with upper contact noses 60*u* above upper plate side 92 and lower contact noses 60*d* below lower plate side 94. The lower contact noses 60*d* are below the socket walls.

The spacing between adjacent contact arms 18 is greater than the spacing between adjacent interposer contacts 88, although in other embodiments the relative spacings could vary.

The illustrated interposer plate 86 normally holds interposer contacts 88 centered in the plate, with upper contact noses 90*u* and lower contact noses 90*d* in common horizontal planes equally spaced from plate top and bottom plate sides 92, 94 respectively. When the interposer is held in frame 12 the upper contact noses 90*u* are substantially even or flush with the upper contact noses 60*u* and lower contact noses 90*d* are substantially even or flush with lower contact noses 60*d* as shown in FIG. 11.

Interposer contacts in some types of interposers are normally held off-center in the interposer plate. The unstressed interposer contact noses in such interposers do not lay in common planes with the contact arm noses when the interposer is in the frame 10 and the interposer contacts are unstressed.

In yet other embodiments the interposer contacts can be normally centered in the plate with upper and lower contact noses spaced respective distances from the top and bottom sides of the plate. The contact noses of the contact arms can be spaced different distances above or below the interposer plate and not lie in common horizontal planes with the interposer contact noses. The free ends of the contacts arm can be entirely below or above the socket walls, depending on the height of the walls and the distance the free end is below or above the interposer plate. The free ends of the contact arms in such embodiments are still considered between the inner wall surfaces of the socket and the interposer even though they may be vertically offset from the plate.

Interposer assembly 82 may be used for forming electrical connections between contact pads on a ceramic integrated circuit and contact pads of a circuit board. The assembly may also be used for forming electrical connections between other types of contact members or other types of circuit members.

Figure 12:
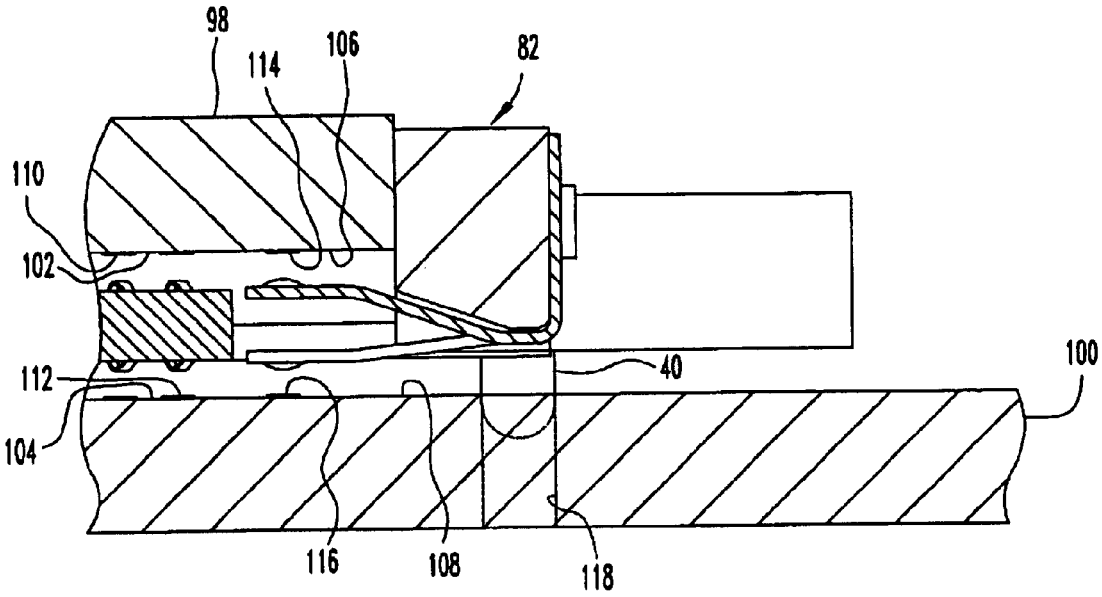
FIG. 12 is a view similar to FIG. 11 prior to the interposer assembly being sandwiched between a pair of circuit members.

FIG. 12 illustrates the interposer assembly 82 positioned between upper and lower circuit members 98 and 100 prior to being sandwiched between the circuit members. The circuit members 98 and 100 each includes an interior surface 102 and 104 respectively directly above or below the interposer plate 86 and a surrounding outer peripheral surface 106, 108 respectively that extends outwardly beyond interposer plate 86 directly above or below the contact arms 18. The circuit members 98, 100 include a first set of opposed pairs of contact pads 110, 112 mounted on the inner surfaces of the circuit members and a second set of opposed pairs of contact pads 114, 116 mounted on the outer peripheral surfaces of the circuit members.

The lower circuit member 100 extends beyond the interposer assembly 82. Locator holes 118 in the circuit member 100 receives frame locator posts 40 and position the interposer assembly with respect to the circuit member. The upper circuit member 98 is received within close-fitting socket 12 from the top side of the socket 12 as viewed in FIG. 12. The circuit members 98, 100 are spaced away from the interposer assembly 82 and the contact arms 18 and the interposer contacts 88 are not compressed.

Interposer contacts 88 are arranged to engage and interconnect opposing pairs of interior contact pads 110, 112. Contact pads 110, 112 are directly opposite contact noses 90*u*, 90*d*. The arrangement of the interposer contacts 88 and contact pads 110, 112 is conventional and will not be described in greater detail. In other embodiments the interposer contacts can be arranged to engage opposed, but offset, pairs of contact pads.

Each set of contact arms 18 is arranged to engage and interconnect sets of opposing but offset pairs of outer contact pads 114, 116 extending along a side of the interposer plate adjacent the set of contact arms. The sets of contact pads 114, 116 are arranged as a linear one-dimensional array of pads so that each contact pad 114, 116 contacts an individual contact nose 60*u* and 60*d* respectively. Alternatively, contact pads 114 or 116 can be formed as one or more elongate contact pads that each simultaneously engages a number of contact noses 60*u* or 60*d*.

In other embodiments contact pads 114, 116 can be arranged to be various distances from the frame wall 20 and form a 2-dimensional array of pads. The contact arms 18*u*, 18*d* can extend various lengths beyond the side wall 20 to engage the contact pads. The interposer contacts 88 and the contact arms 18 can form electrical connections between different numbers of contact pads. Different types of interposer plates, interposer contacts, and contact arm contacts can be used.

Figure 13:
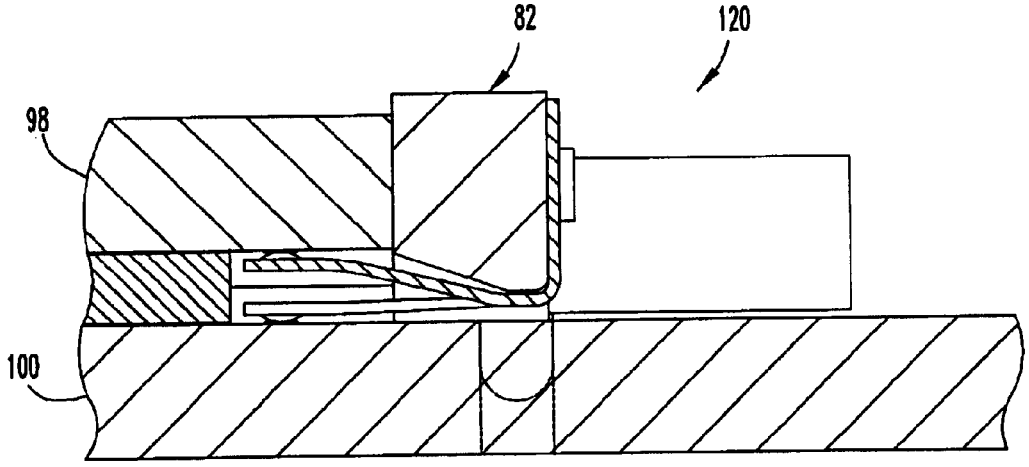
FIG. 13 is a view similar to FIG. 12 but showing the interposer assembly sandwiched between the circuit members.

FIG. 13 illustrates an electronics package 120 formed by sandwiching the interposer assembly 82 between circuit members 100 and 102. The circuit members are pressed together by a pressure plate (not shown), which can be a component of a conventional clamp used to clamp circuit members together. The clamp can include tension members (not shown) that extend through frame mounting holes 38 and press the frame against the lower circuit member 100.

When the circuit members are brought toward the interposer plate 86, the two sets of interior contact pads 110, 112 move toward each other and engage the upper and lower contact noses 90*u*, 90*d* of the interposer contacts 88. The two sets of outer peripheral contact pads 114, 116 also move toward each other and engage the upper and lower contact arm contact noses 60*u* and 60*d*. The contact arms 18 and the interposer contacts 88 act as springs that elastically deform and make low resistance pressure electrical connections between the contact noses and the contact pads.

The deflections of the contact noses 60*u*, 60*d* and 90*u*, 90*d* from their normal unstressed position to the clamped position are each equal. In other embodiments the distance between contact noses 60*u*, 60*d* and contact noses 90*u*, 90*d* are different from each other so that the deflections of the contact noses differ from the corresponding deflections of the interposer contact noses. Different deflections may be desirable in some embodiments to compensate for different resiliencies or spring rates of the contact arms 18 as compared to the interposer contacts 88.

Circuit members 98 and 100 are clamped tightly against the interposer plate 86 and the frame 12 is pressed tightly against the lower circuit member 100. Interior contact pads 110, 112 abut the top and bottom sides of interposer plate 86 and support the circuit members against the plate.

EMI shield 16 extends around the interposer 84 and shields the interposer 84 from EMI radiation. EMI shield 16 is electrically connected to the circuit members 98, 100. Each shield plate 44 and the set of contact arms 18 extending from the shield plate are a single unitary piece so that the set of contact arms 18 are electrically connected to the portion of the EMI shield 16 formed by the shield plate. In this embodiment the contact arms 18 ground the shield plates 44 and the circuit members 98, 100 to a common ground through the sets of contact pads 114 or 116. The ground drains induced currents from the EMI shield 16.

In other embodiments each or some of the shield plates 44 can be connected to a ground or voltage source independent of the other shield plates. In yet other embodiments the contact arms 18 can transmit data signals, conduct heat, apply voltage differentials, flow electrical current, or otherwise electrically or thermally interconnect the circuit members 98, 100.

The circuit members may move towards and away from each other due to changes in operating temperature, user handling, or the like. The contact arms 18 and the interposer contacts 88 resiliently deflect to maintain electrical or thermal contact with the circuit members despite the relative movement of the circuit members.

Figure 14:
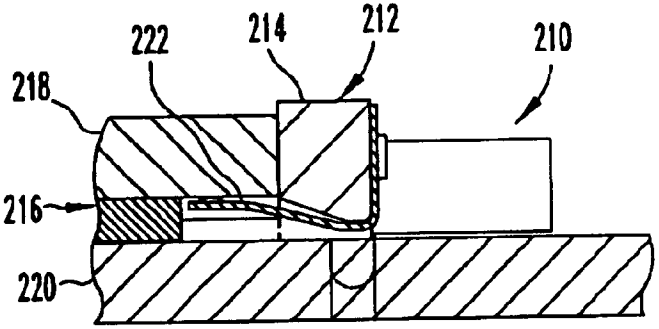
FIG. 14 is a partial sectional view of an electronics package having an interposer assembly in a second embodiment frame in accordance with the present invention, the interposer assembly sandwiched between a pair of circuit members.

FIG. 14 illustrates an electronics package 210 formed with a second embodiment shielded frame 212 in accordance with the present invention. Frame 212 has a socket 214 similar to the socket 12 that mounts an interposer 216 similar to interposer 84. Frame 212 is sandwiched between upper and lower circuit members 218 and 220. The frame 212 includes only upwardly bent contact arms 222, like contact arms 18*u*, having contact noses that engage contact pads on the upper circuit member. Only the upper circuit member 218 is electrically connected to the EMI shield of frame 212.

Figure 15:
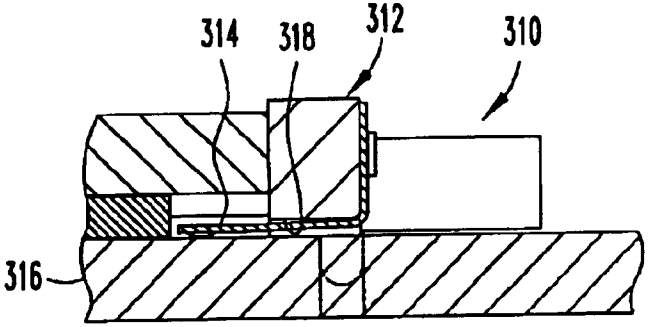
FIG. 15 is a partial sectional view of an electronics package having an interposer assembly in a third embodiment frame in accordance with the present invention, the interposer assembly sandwiched between a pair of circuit members.

FIG. 15 illustrates an electronics package 310, similar to package 210, formed with a third embodiment shielded frame 312 in accordance with the present invention. Frame 312 is similar to frame 212 but includes only downwardly bent contact arms 314. Only the lower circuit member 316 is electrically connected to the EMI shield of frame 312. The recessed bottom surfaces 318 of the socket are horizontal surfaces because there is no need to accommodate upwardly bent contact arms.

Figure 16:
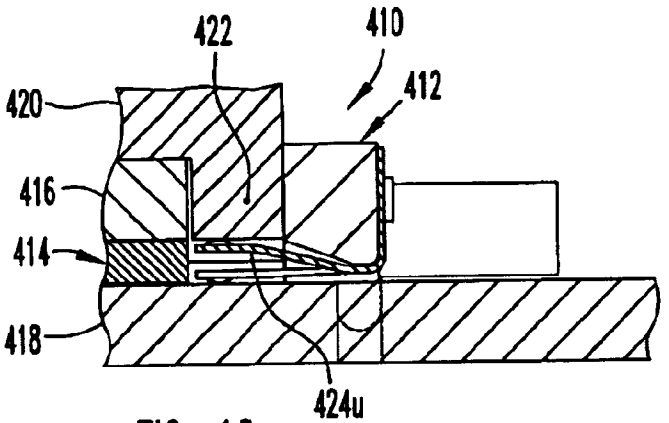
FIG. 16 is a partial sectional view of an electronics package having an interposer assembly in a fourth embodiment frame in accordance with the present invention, the interposer assembly sandwiched between a pair of circuit members, a heat sink pressed against the upper circuit member.

FIG. 16 illustrates an electronics package 410 formed with a fourth embodiment frame 412 like frame 10. An interposer 414 is sandwiched between upper and lower circuit members 416 and 418. Upper circuit member 416 is sized to fit against the interposer plate without overhanging the plate. A heat sink 420 is mounted on the upper circuit member 416 and conducts heat away from the circuit member. The heat sink includes downwardly extending legs 422 that engage the upper contact arms 424*u*. The contact arms transfer heat generated in the EMI shield to the heat sink. The contact arms engaging the heat sink in other embodiments have flat contact noses to increase heat transfer area between the arms and the heat sink.

Figure 17:
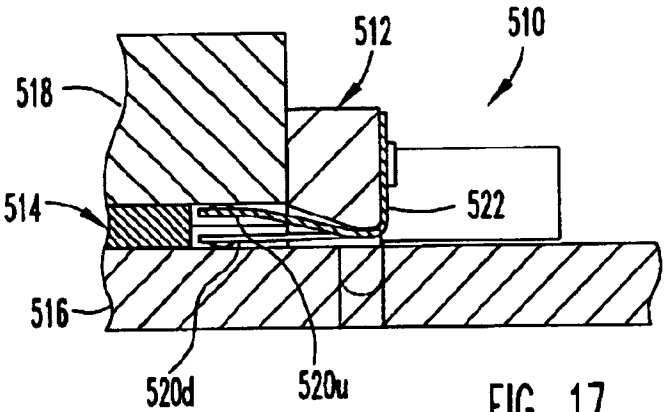
FIG. 17 is a partial sectional view of an electronics package having an interposer assembly in a fifth embodiment frame in accordance with the present invention, the circuit device including an active circuit member sandwiched between a heat sink and a lower circuit member.

FIG. 17 illustrates an electronics package 510 formed with a fifth embodiment frame 512 similar to frame 10. In this embodiment an active circuit device 514 is held in the frame 512 and pressed against a lower circuit member 516. The circuit device 514 has flat upper and lower surfaces and may include a microprocessor or other electronic device. A heat sink 518 on circuit device 514 presses against the circuit device 514 and is in intimate thermal contact with the device 514. The heat sink overhangs the circuit device and engages upper contact arms 520*u*. The upper arms and the lower contact arms 520*d* electrically interconnect the heat sink, the lower circuit member 516 and the EMI shield 522 to a common ground. The EMI shield reduces transmission of EMI generated by the active circuit device while the heat sink transfers heat away from the EMI shield.

While I have illustrated and described preferred embodiments of my invention, it is understood that these are capable of modification, and I therefore do not wish to be limited to the precise details set forth, but desire to avail myself of such changes and alterations as fall within the purview of the following claims.

I claim:

1. An EMI-shielded frame for holding a circuit device to be sandwiched between a pair of circuit members, the frame comprising:

a socket for holding the circuit device, an EMI shield assembly at least partially surrounding the socket, and means for mounting the shield assembly to the socket;

the socket comprising a wall surrounding a central opening, the central opening extending through the socket for receiving the circuit device, and means for mounting the circuit device in the socket, the wall comprising an inner surface facing the opening, an outer surface defining the outer perimeter of the wall, and top and bottom surfaces;

the shield assembly facing the outer and bottom wall surfaces, the shield assembly comprising an EMI shield facing the outer surface of the socket and at least one contact arm extending from the shield and electrically or thermally connected to the shield;

each contact arm extending from below the bottom wall surface inwardly beyond the inner wall surface to a free end, a contact surface on the free end to face one of the circuit members, the contact surface being disposed to engage the one circuit member when the circuit device is sandwiched between the circuit members and thereby electrically or thermally interconnect the one circuit member with the EMI shield.

2. The frame of claim 1 wherein the at least one contact arm comprises one of an upwardly bent portion and a downwardly bent portion.

3. The frame of claim 1 wherein the EMI shield comprises a plurality of individual spaced-apart shield members, at least one of the shield members comprising the at least one contact arm.

4. The frame of claim 1 wherein the at least one contact arm comprises a plurality of first contact arms, the contact noses of the first contact arms defining a common plane.

5. The frame of claim 4 wherein the contact noses of the first contact arms are arranged in a linear row.

6. The frame of claim 1 wherein the at least one contact arm comprises a first contact arm and a second contact arm, the contact nose of the first contact arm vertically spaced from the contact nose of the second contact arm.

7. The frame of claim 6 wherein the first and second arms are adjacent each other.

8. The frame of claim 1 wherein the at least one contact arm comprises a plurality of first contact arms and a plurality of second contact arms, the contact noses of the first contact arms disposed in a first common plane to face the one circuit member and the contact noses of the second contact arms disposed in a second common plane vertically spaced from the first plane to face the other circuit member whereby the contact noses of the first contact arms electrically or thermally interconnect the one circuit member with the EMI shield and the contact noses of the second contact arms electrically or thermally interconnect the other circuit member with the EMI shield when the circuit device is sandwiched between the circuit members.

9. The frame of claim 8 wherein the first contact arms are upwardly bent and the second contact arms are downwardly bent to locate the contact noses in the first and second planes.

10. The frame of claim 8 wherein the first and second contact arms are alternately spaced along the EMI shield.

11. The frame of claim 3 wherein the at least one contact arm comprises a plurality of contact arms and each shield member comprises at least one of the contact arms.

12. The frame of claim 3 wherein the at least one shield member comprising the at least one contact arm is a one-piece member.

13. The frame of claim 12 wherein the one-piece member is formed from metal sheet.

14. An EMI-shielded interposer assembly for interconnecting a pair of circuit devices, the interposer assembly comprising:

an interposer, an EMI-shielded frame, and means for mounting the interposer in the frame;

the interposer comprising a flat plate and a plurality of contacts in the plate, the plate having top and bottom sides separated by the thickness of the plate, the contacts having opposed contact noses separated by a distance greater than the thickness of the plate;

the frame comprising a hollow socket, the interposer in the socket, an EMI shield assembly at least partially surrounding the socket, and structure mounting the shield assembly to the socket;

the socket comprising an inner surface facing and spaced from the interposer plate, top, bottom and outer surfaces, and means for locating the interposer with respect to one or both of the circuit devices;

the shield assembly adjacent to and facing the outer and bottom socket surfaces, the shield assembly comprising a shield plate facing the outer surface of the socket and at least one contact arm extending from the shield plate;

each contact arm extending from below the bottom wall surface inwardly beyond the inner wall surface to a free end between the interposer plate and the inner wall surface, a contact surface on the free end to face one of the circuit members, the contact surface being disposed to engage the one circuit member when the interposer plate is sandwiched between the circuit members and thereby electrically or thermally interconnect the one circuit member with the EMI shield.

15. The interposer assembly of claim 14 wherein each contact nose is spaced above or below the interposer plate when the contact arm comprising the contact nose is unstressed.

16. The interposer assembly of claim 15 wherein the at least one contact arm comprises a plurality of contact arms, the contact noses of the contact arms defining a plane spaced above or below the interposer plate when the contact arms are unstressed.

17. The interposer assembly of claim 15 wherein the at least one contact arm comprises a first contact arm and a second contact arm;

the contact nose of the first contact arm is above the interposer plate and the contact nose of the second contact arm disposed is below the interposer plate when the contact arms are unstressed.

18. The interposer assembly of claim 17 comprising a plurality of first contact arms and a plurality of second contact arms, the contact noses of the first contact arms defining a first plane spaced above the interposer plate, and the contact noses of the second contact arms defining a second plane spaced below the interposer plate.

19. The interposer assembly of claim 17 wherein the contact noses of each interposer contact are vertically spaced a first distance apart from one another when the interposer contacts are unstressed, and the contact nose of the first contact arm and the contact nose of the second contact arm are vertically spaced the first distance apart from one another when the contact arms are unstressed.

20. The interposer assembly of claim 19 wherein the contact noses of each interposer contact comprises an upper contact nose and a lower contact nose, the upper contact noses and the contact nose of the first contact arm defining a first plane above the interposer plate, and the lower contact noses and the contact nose of the second contact arm defining a second plane below the interposer plate when the interposer contacts and the first and second contact arms are unstressed.

21. An EMI-shielded electronics package comprising:

a first circuit member, a second circuit member, a circuit device sandwiched between the first and second members, one of the circuit members comprising a side facing the circuit device and extending outwardly beyond the circuit device, a frame, the circuit device in the frame, and means for locating the circuit device with respect to the first and second circuit members;

the frame comprising a hollow socket, the circuit device in the socket, and an EMI shield assembly at least partially surrounding the socket;

the socket comprising an inner surface facing the circuit device and spaced from the circuit device, and top, bottom and outer surfaces;

the shield assembly facing the outer and bottom wall surfaces, the shield assembly comprising an EMI shield at least partially surrounding the socket and at least one contact arm extending from the shield and electrically or thermally connected to the shield;

the at least one contact arm extending from below the bottom wall surface inwardly beyond the inner wall surface to a free end between the circuit device and the inner wall surface, a contact surface on the free end facing the one circuit member, the contact surface engaging the surface of the one circuit member and thereby electrically or thermally interconnecting the one circuit member with the EMI shield.

22. The electronics package of claim 21 wherein the one circuit member is a heat sink.

23. The electronics package of claim 21 wherein the circuit device is an active circuit device that generates EMI when operating.

24. The electronics package of claim 21 wherein the one circuit member is at least partially in the socket.

25. The electronics package of claim 21 wherein the one circuit member elastically deflects each contact arm towards the other circuit member.

26. The electronics package of claim 21 wherein the surface of the one circuit member comprises a contact pad that engages the contact nose of the at least one contact arm.

27. The electronics package of claim 21 wherein the other circuit member comprises a side facing the circuit device and extending outwardly beyond the circuit device;

the at least one contact arm comprises a first contact arm and a second contact arm, the first contact arm engaging the one circuit member;

the second contact arm comprises a contact nose facing the other circuit member and engaging the surface of the other circuit member and thereby electrically or thermally interconnecting the other circuit member with the EMI shield.

28. The electronics package of claim 27 wherein the circuit member has flat top and bottom sides separated by the thickness of the plate and the contact noses of the first and second contact arms are normally spaced a distance greater than the thickness of the plate when unstressed.

* * * * *

UNITED STATES PATENT AND TRADEMARK OFFICE

CERTIFICATE OF CORRECTION

PATENT NO. : 6,780,056 B1 
DATED : August 24, 2004
INVENTOR(S) : Douglas A. Neidich It is certified that error appears in the above-identified patent and that said Letters Patent is hereby corrected as shown below:

Drawings,
Firgure 6, substitute the following drawing:

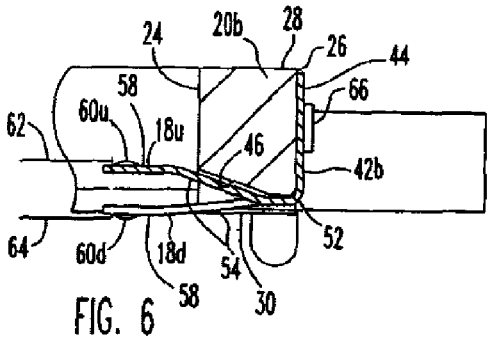

FIG. 6

Figure 10, substitute the following drawing:

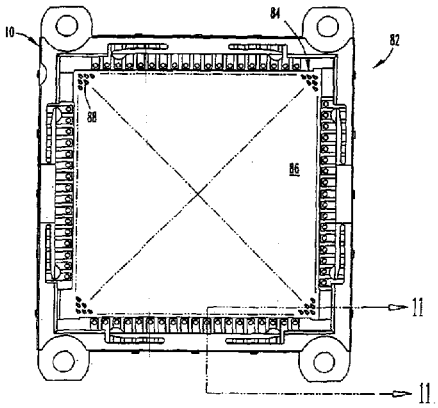

FIG. 10

Column 10,
Lines 26, 27, 37, 39, 42, 44 and 50, replace "noses" with -- surfaces --.
Lines 31 and 32, replace "nose" with -- surface --.

UNITED STATES PATENT AND TRADEMARK OFFICE

CERTIFICATE OF CORRECTION

PATENT NO. : 6,780,056 B1
DATED : August 24, 2004
INVENTOR(S) : Douglas A. Neidich It is certified that error appears in the above-identified patent and that said Letters Patent is hereby corrected as shown below:

Column 11,
Lines 16, 17, 18 and 25, delete "wall".
Line 23, delete both occurrences of "wall".
Lines 25, 26, 36, 37, 49, 50, 56 and 58, replace "nose" with -- surface--.
Lines 30, 42 and 44, replace "noses" with -- surfaces --.
Line 38, replace "disposed is" with -- is disposed --.
Line 45, after "plate" insert -- when the contact arms are unstressed --.

Column 12,
Lines 43 and 50, replace "nose" with -- surface --.
Line 57, replace "noses" with -- surfaces --.

Signed and Sealed this

Twelfth Day of July, 2005

JON W. DUDAS
*Director of the United States Patent and Trademark Office*